US009470172B2

(12) United States Patent
Katsura

(10) Patent No.: US 9,470,172 B2
(45) Date of Patent: Oct. 18, 2016

(54) FUEL INJECTION APPARATUS

(71) Applicant: DENSO CORPORATION, Kariya, Aichi-pref. (JP)

(72) Inventor: Ryou Katsura, Anjo (JP)

(73) Assignee: DENSO CORPORATION, Kariya (JP)

( * ) Notice: Subject to any disclaimer, the term of this patent is extended or adjusted under 35 U.S.C. 154(b) by 350 days.

(21) Appl. No.: 14/164,284

(22) Filed: Jan. 27, 2014

(65) Prior Publication Data

US 2014/0216409 A1 Aug. 7, 2014

(30) Foreign Application Priority Data

Feb. 1, 2013 (JP) ..... 2013-18901

(51) Int. Cl.

| | |
|---|---|
| ***F02M 1/00*** | (2006.01) |
| ***F02D 41/38*** | (2006.01) |
| ***F02D 41/00*** | (2006.01) |
| ***F02D 41/24*** | (2006.01) |

(52) U.S. Cl.

CPC ..... *F02D 41/3809* (2013.01); *F02D 41/0085* (2013.01); *F02D 41/2467* (2013.01); *F02D 41/247* (2013.01); *F02D 2200/0602* (2013.01); *F02D 2200/0616* (2013.01)

(58) Field of Classification Search

CPC ..... F02M 63/0225; F02M 63/023; F02M 65/00; F02M 65/001

USPC ..... 123/434, 673, 445, 447, 456, 457; 701/104

See application file for complete search history.

(56) References Cited

U.S. PATENT DOCUMENTS

| | | | | |
|---|---|---|---|---|
| 2004/0158384 | A1 | 8/2004 | Kuegel et al. | |
| 2005/0235964 | A1 | 10/2005 | Shibata | |
| 2009/0063018 | A1* | 3/2009 | Takeuchi | F02D 41/1497 701/104 |
| 2009/0326788 | A1 | 12/2009 | Yuasa et al. | |
| 2012/0209544 | A1* | 8/2012 | Takashima | F02D 41/221 702/50 |
| 2012/0330576 | A1* | 12/2012 | Mikami | F02M 57/005 702/50 |
| 2013/0054120 | A1* | 2/2013 | Yamada | F02D 41/247 701/104 |

FOREIGN PATENT DOCUMENTS

| | | |
|---|---|---|
| JP | 2006-002698 | 1/2006 |
| JP | 2006-200378 | 8/2006 |
| WO | WO 2011/039889 | 4/2011 |

OTHER PUBLICATIONS

Office Action (2 pages) dated Mar. 24, 2015 issued in corresponding Japanese Application No. 2013-018901 and English translation (3 pages).

* cited by examiner

*Primary Examiner* — John Kwon
(74) *Attorney, Agent, or Firm* — Nixon & Vanderhye P.C.

(57) ABSTRACT

An individual difference index is obtained based on the slope of variation ratios between a plurality of actual injection quantity and a target injection quantity. The individual difference index is stored as a learning value. An individual difference correction of the fuel injector is conducted based on the individual difference index. By using the individual difference index, a shot-dispersion is removed and individual-difference correction of the fuel injector can be conducted.

6 Claims, 5 Drawing Sheets

FUEL INJECTION APPARATUS

CROSS-REFERENCE TO RELATED APPLICATION

This application is based on Japanese Patent Application No. 2013-18901 filed on Feb. 1, 2013, the disclosure of which is incorporated herein by reference.

TECHNICAL FIELD

The present disclosure relates to a fuel injection apparatus which injects a fuel accumulated in a common-rail through a fuel injector.

BACKGROUND

An individual difference (machine difference) of a fuel injector is held in a specified standard in a manufactory. As shown in JP-2006-200378A, the individual difference information is marked on the fuel injector by using of QR code (trademark). When the fuel injector is assembled to an engine, a control unit (ECU etc.) reads the QR code in order to perform an individual-difference correction.

However, in some regions, a reading device for reading the QR code and a writing device for writing the QR code are not spread enough. In such regions, the individual-difference correction by using of the QR code can not be conducted.

In such a case, it is necessary to enhance the individual difference accuracy of the fuel injector, which increases a manufacturing cost of the fuel injector.

In a case that the individual-difference correction of the fuel injector can not be conducted, an output difference arises between cylinders. Thus, a torque fluctuation become large, a fuel consumption is deteriorated, and an engine vibration and an engine noise become large.

Furthermore, when an inferior fuel is used, the fuel injector may be deteriorated. Even if the individual difference is corrected before a shipment, the individual difference may arise due to the deterioration of the fuel injector.

Meanwhile, based on the fuel pressure detected by a fuel pressure sensor provided to a common-rail, the individual-difference correction of the fuel injector may be conducted. However, a fuel injection quantity has dispersion in each injection, which is referred to as a shot-dispersion. Thus, the fuel pressure in the common-rail does not become stable, so that the individual-difference correction is difficult to be conducted.

Further, when the engine load is high, the individual-difference correction can not be conducted.

Due to the above reasons, the individual-difference correction based on the common-rail pressure can not be practically conducted.

SUMMARY

It is an object of the present disclosure to provide a fuel injection apparatus which is able to practically conduct an individual-difference correction of a fuel injector by using of a pressure sensor provided to a common-rail.

A fuel injection apparatus computes actual injection quantity Q based on a fuel pressure drop ΔP detected by the pressure sensor when the fuel is injected. The individual difference index % Q is obtained based on the slope of "variation ratio Q/Qtrg" and the individual difference index % Q is stored as a learning value. The individual difference correction of the fuel injector is conducted based on the individual difference index % Q.

By using the individual difference index % Q as an index of the individual difference, a shot-dispersion is removed and individual-difference correction of the fuel injector can be performed. Moreover, based on the individual difference index % Q obtained under a condition where an engine load is low, the individual-difference correction can be conducted in whole range of the injector property. That is, the individual-difference correction of the fuel injector can be practically conducted by means of the pressure sensor provided to the common-rail.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Referring to drawings, embodiments of the present disclosure will be described hereinafter.

First Embodiment

The present disclosure will be described with reference to embodiments thereof. It is to be understood that the disclosure is not limited to the embodiments and constructions.

Referring to FIGS. 1 to 6, a fuel injection apparatus of a first embodiment will be described hereinafter.

Figure 1:
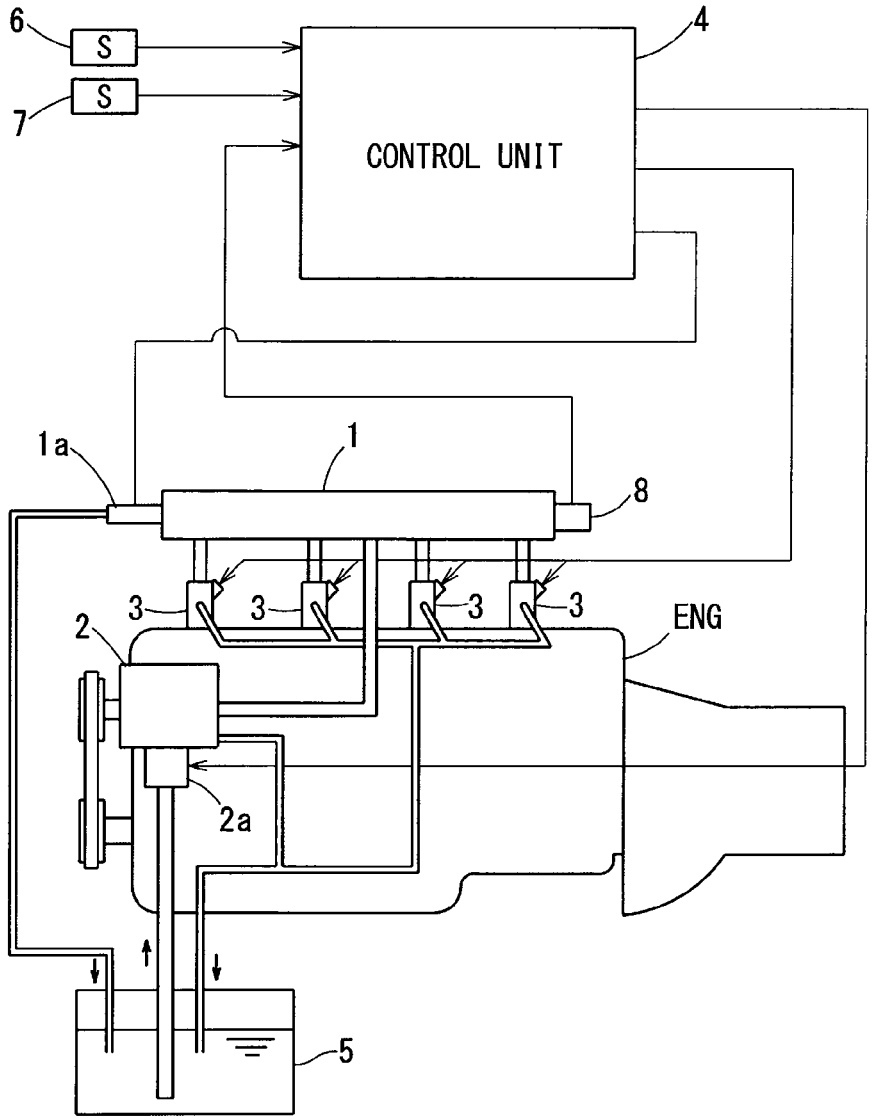
FIG. 1 is a schematic view of a fuel injection apparatus.
Figure 2:
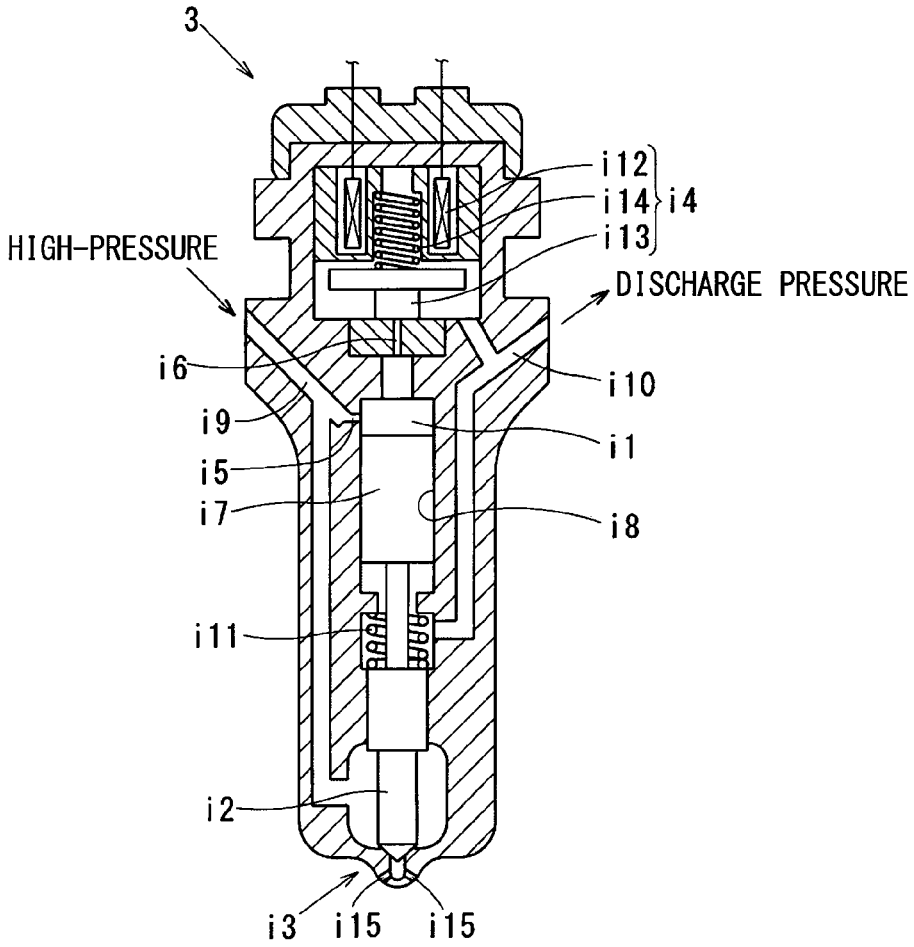
FIG. 2 is a schematic view of a fuel injector.
Figure 3:
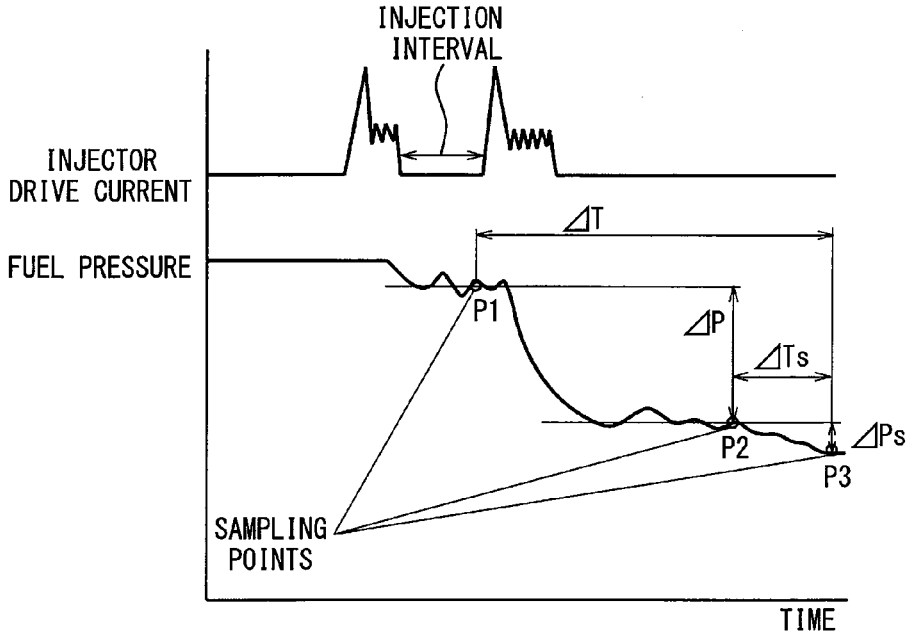
FIG. 3 is a chart showing a fuel pressure waveform.

The fuel injection apparatus is a system which performs fuel injection to a diesel engine, for example. The diesel engine is referred to as the engine ENG, hereinafter. As shown in FIG. 1, the fuel injection apparatus is provided with a common-rail 1, a supply pump 2, injectors 3 and a control unit 4. The control unit 4 is comprised of an electronic control unit (ECU), and electronic drive unit (EDU).

The common-rail 1 is an accumulator accumulating high-pressure fuel supplied from the supply pump 2. The accumulated high-pressure fuel is supplied to the fuel injectors 3.

The supply pump 2 is provided with a high-pressure pump which pressurizes the fuel suctioned from a fuel tank 5 by a feed pump (low-pressure pump). The pressurized high-pressure fuel is introduced into the common-rail 1.

The supply pump 2 has a metering valve 2*a* which adjusts a feed quantity of the high-pressure pump. The control unit 4 controls the metering valve 2*a* and a pressure-reducing valve 1*a* so that the fuel pressure in the common-rail 1 is adjusted to a target pressure.

Each fuel injector 3 is mounted to each cylinder of the engine ENG. When the control unit 4 energizes the fuel injector 3, the fuel injector 3 injects the high-pressure fuel accumulated in the common-rail 1 into the cylinder. When the control unit 4 deenergizes the fuel injector 3, the fuel injection is terminated.

In the present embodiment, two-way fuel injector 3 is employed. The type of the fuel injector 3 is not limited to two-way type. The fuel injector 3 is an electromagnetic fuel injection valve which has a nozzle i3 and an electromagnetic valve i4. When the high-pressure fuel pressure is introduced into a backpressure chamber i1 (control chamber), the needle i2 closes the nozzle i3. The electromagnetic valve i4 is for discharging the high-pressure fuel in the backpressure chamber i1.

Specifically, the fuel injector 3 injects the high pressure fuel supplied from the common-rail 1 into the cylinder of the engine ENG. The high-pressure fuel in the common-rail 1 is introduced into the backpressure chamber i1 through an inflow passage i5. The inflow passage i5 has an in-orifice therein. The backpressure chamber i1 also communicates with a discharge passage i6. The discharge passage i6 has an out-orifice therein. The electromagnetic valve i4 opens and closes the discharge passage i6 so that the fuel pressure in the backpressure chamber i1 is varied. When the fuel pressure in the backpressure chamber i1 is decreased to a specified value, the needle i2 slides up to open injection ports i50 of the nozzle i3.

In a housing of the fuel injector 3, a cylinder i8, a high-pressure fuel passage i9, and a low-pressure fuel discharge passage i10 are formed. The cylinder i8 supports a command piston i7 in its axial direction. The high-pressure fuel passage i9 introduces the high-pressure fuel supplied from the common-rail 1 toward the nozzle i3 and the inflow passage i5. The low-pressure fuel discharge passage i10 is for discharging the high-pressure fuel toward a low-pressure portion.

The command piston i7 is inserted in the cylinder i8 and is connected to the needle i2 through a pressure pin. The pressure pin is arranged between the command piston i7 and the needle i2. A spring i11 is disposed around the pressure pin. The spring i11 biases the needle i2 downward (valve close direction).

The backpressure chamber i1 is defined above the cylinder i8. A volume of the backpressure chamber i1 is varied according to an axial movement of the command piston i7. The inflow passage i5 is a fuel throttle which reduces the pressure of the fuel supplied through the high-pressure fuel passage i9. The high-pressure fuel passage i9 and the backpressure chamber i1 communicate with each other through the inflow passage i5. The discharge passage i6 is formed above the backpressure chamber i1. The discharge passage i6 is a fuel throttle which reduces the pressure of the fuel discharged to the low-pressure fuel discharge passage i10. The backpressure chamber i1 and the low-pressure fuel discharge passage i10 communicate with each other through the discharge passage i6.

The electromagnetic valve i4 has a solenoid i12, a valve i13 and a return spring i14. The solenoid i12 generates an electromagnetic force when energized. The valve 13 is attracted toward the solenoid i12. That is, the valve 13 is attracted in a valve-open direction. The return spring i14 biases the valve i13 in a valve-close direction. For example, the valve i13 is a ball valve which opens and closes the discharge passage i6. When the solenoid i12 is OFF, the valve i13 is biased downward by the return spring i14 to close the discharge passage i6.

Meanwhile, when the solenoid i12 is ON, the valve i13 is attracted toward the solenoid i12 against the biasing force of the return spring i14, so that the valve i13 opens the discharge passage i6.

The housing of the injector 3 has a hole into which the needle i2 slidably inserted, a nozzle chamber annularly formed around the needle i2, a conical valve seat on which the needle i2 sits, and an injection port i15 through which the high-pressure fuel is injected.

The needle i2 is comprised of a sliding shaft portion, a small diameter shaft and a conical valve which opens and closes the injection port i15. The sliding shaft portion seals a clearance between the nozzle chamber and a space around the return spring i11.

The conical valve of the needle 12 is comprised of a conical base portion and a conical tip end portion. A valve-sit seat is formed between the conical base portion and the conical tip end portion. A conical angle of the conical base portion is smaller than that of the conical tip end portion. A conical angle of the conical tip end portion is larger than that of the valve seat. When the valve-sit seat is contact with the valve seat, the injection ports i15 are closed.

An operation of the fuel injector 3 will be described.

When the fuel injector 3 is energized, the electromagnetic valve i4 attracts the valve i13. When the valve i13 is lifted up, the discharge passage i6 is opened, so that the fuel pressure in the backpressure chamber i1 is decreased. When the fuel pressure in the backpressure chamber i1 is lowered than the specified value, the needle i2 starts lifting up. When the needle i2 is apart from the valve seat, the nozzle chamber communicates with the injection ports i15 and the high pressure fuel in the nozzle chamber is injected through the injection ports i15.

When the fuel injector is deenergized, the electromagnetic valve i4 stop generating the electromagnetic attracting force. The valve i13 starts lifting down. When the valve i13 closes the discharge passage i6, the fuel pressure in the backpressure chamber i1 starts increasing. When the fuel pressure in the backpressure chamber i1 is increased up to the specified value, the needle i2 starts sliding down. When the needle i2 sits on the valve seat, the nozzle chamber and the injection ports i15 are fluidly disconnected so that the fuel injection is terminated.

The control unit 4 includes a well-known microcomputer. The control unit 4 receives various sensor signals from the various sensors. Based on the sensor signals, the control unit 4 executes various computations to perform a pressure control of the common-rail 1 and a driving control of the fuel injector 3. In this embodiment, an accelerator sensor 6 detecting an accelerator position, an engine speed sensor 7, and a pressure sensor 8 detecting the fuel pressure in the-common-rail 1 are connected to the control unit 4.

The control unit 4 computes the target-injection-start timing and the target injection quantity "Qtrg" with respect to each fuel injection according to control programs stored in the ROM and the control parameters transmitted from the sensors. Then, the control unit 4 controls the fuel injector 3 in such a manner that the fuel injection is started at the target-injection-start timing and the fuel injection quantity agrees with the target injection quantity "Qtrg".

Specifically, the control unit 4 obtains a target-energization period "Tq" based on the target injection quantity "Qtrg" and the fuel pressure in the common-rail 1. The target-energization period "Tq" is a command pulse length from the energization-start timing until the energization-end timing.

The fuel injector 3 has an individual difference (machine difference). It is preferable that the individual difference of the fuel injector 3 is corrected before shipment.

The individual difference of the fuel injector 3 may gradually vary due to an abrasion wear of moving parts, clogged injection ports, etc. That is, the actual injection quantity "Q" may deviate from the target injection quantity "Qtrg" due to the abrasion wear , the clogging of the injection port, etc.

In order to avoid the above problems, according to the present embodiment, the control unit 4 has an individual difference correcting portion (control program) correcting the individual difference by means of the pressure sensor 8 provided to the common-rail 1.

The control unit 4 monitors the pressure of the accumulated fuel by means of the pressure sensor 8. The control unit 4 computes actual injection quantity "Q" based on a fuel pressure drop ΔP detected by the pressure sensor 8 when the fuel is injected. Specifically, the actual injection quantity "Q" is obtained according to a following formula.

$$Q=(V/E)\times\Delta P-(Qd+Qst)$$

wherein "V" represents a volume of the common-rail 1, "E" represents volume modulus of the fuel, "Qd" represents a dynamic leak amount due to an operation of the injector 3, and "Qst" represents a static leak amount in the injector 3.

The control unit 4 computes the actual injection quantity "Q" in view of the leak amount (dynamic leak amount "Qd" and static leak amount "Qst").

The control unit 4 stores the actual injection quantities Q1, Q2, Q3 . . . Qn with respect to each fuel injection. The control unit 4 divides each actual injection quantity by the target injection quantity "Qtrg" to obtain a ratio between the actual injection quantity "Q" and the target injection quantity "Qtrg". This ratio "Q/Qtrg" is referred to as "variation ratio". This "variation ratio" is used as an index of the correction. Furthermore, in order to remove the dispersion in variation ratio between fuel injections, the "variation ratios" are averaged to obtain an individual difference index % Q. Then, the control unit 4 stores the individual difference index % Q as a learning value, and performs an individual difference correction of the fuel injector 3.

The individual difference index % Q is expressed by following formula.

$$\%Q = AVE\sum_{k=1}^{n}(Qk/Qtrg)$$

Figure 4:
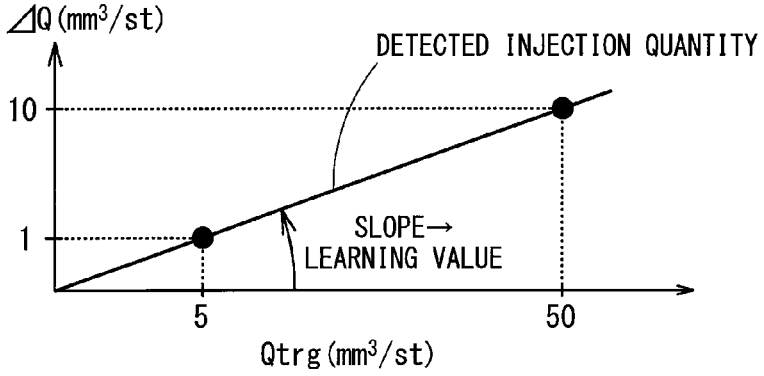
FIG. 4 is a graph showing a relationship between a target injection quantity and an individual difference injection quantity.

It should be noted that a horizontal axis (x-axis) of FIG. 4 indicates that the actual injection quantity "Q" agrees with the target injection quantity "Qtrg". As above, by using the "variation ratio", even if the target injection quantity "Qtrg" is varied in each injection (shot-dispersion), the individual difference index % Q is constant under a constant common-rail pressure.

Therefore, in a case that a common-rail pressure (target pressure) is constant, the individual difference index % Q can be applied to any target injection quantity "Qtrg". That is, when the actual injection quantity "Q" is less than the target injection quantity "Qtrg", the fuel injector injects more fuel corresponding to ΔQ.

$$\Delta Q=\%\ Q\times Qtrg1$$

wherein, "Qtrg1" represents one example of the target injection quantity.

Thus, the individual difference index % Q can be generally used as the constant value, even if the target injection quantity "Qtrg" of the fuel injector 3 is varied.

Meanwhile, the individual difference index % Q can be generally used as the constant value according to the Bernoulli's law even if the target pressure of the common-rail 1 is varied.

Figure 5:
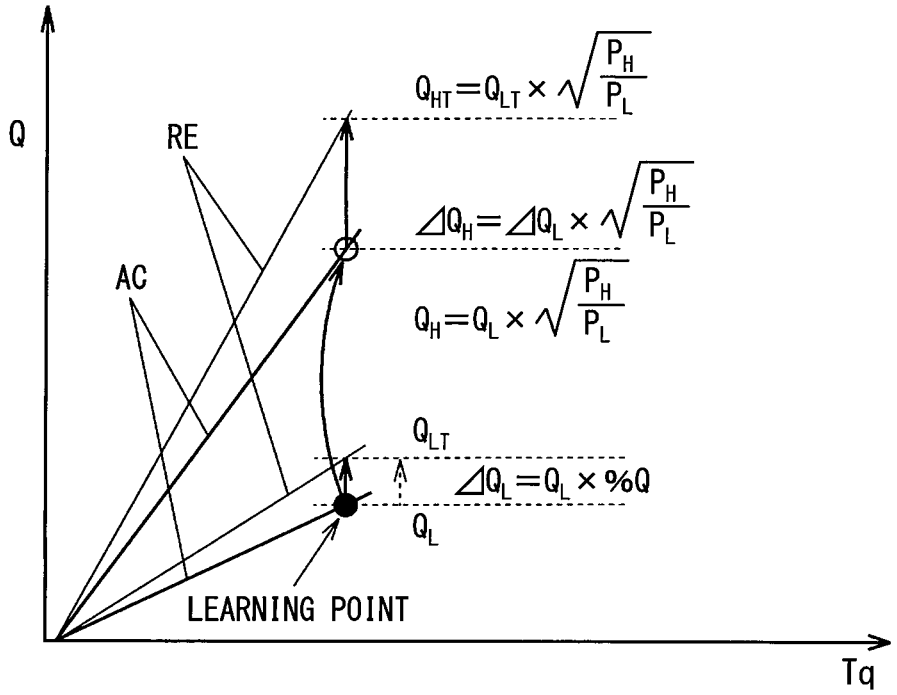
FIG. 5 is a graph showing a relationship between an energization period and a injection quantity.

Referring to FIG. 5, it will be explained in detail. In FIG. 5, solid lines "AC" represent the injection property of the fuel injector 3 before the correction is conducted. Solid lines "RE" represent a target injection property relative to the target-energization period "Tq" (command pulse length).

When the target pressure is low pressure "PL", the target injection quantity is denoted by "QLT", the actual injection quantity is denoted by "QL", and the correction amount is denoted by "ΔQL".

When the target pressure is high pressure "PH", the target injection quantity is denoted by "QHT", the actual injection quantity is denoted by "QH", and the correction amount is denoted by "ΔQH".

According to the Bernoulli's law, $$QHT=QLT\times\sqrt{(PH/PL)}$$

$$QH=QL\times\sqrt{(PH/PL)} \quad (1)$$

$$\Delta QH=\Delta QL\times\sqrt{(PH/PL)} \quad (2)$$

The individual difference index % Q' in high pressure "PH" is obtained from the above formulas (1) and (2).

$$\%Q' = \frac{\Delta QH}{QH} = \frac{\Delta QL\times\sqrt{\frac{PH}{PL}}}{QL\times\sqrt{\frac{PH}{PL}}} = \%Q$$

As mentioned above, the individual difference index % Q obtained under a certain pressure conditions can be generally used as the constant value, even if the target pressure of the common-rail 1 is varied or the target injection quantity "Qtrg" is varied. That is, when the individual difference index % Q is obtained by at least one learning, the individual difference correction of the fuel injector 3 can be conducted in whole drive range.

FIG. 4 is a graph showing a relationship between the target injection quantity "Qtrg" and the individual difference quantity ΔQ. The individual difference index % Q is obtained from a slope of the "variation ratio". In order to obtain the slope, two learning values of the "variation ratio" at different injection quantity are necessary. One learning value may be obtained by well-known small injection learning, and the other learning value may be obtained from the "variation ratio". Alternatively, two learning values may be obtained from the "variation ratio" at different injection quantity "Q".

In a case that two learning values are obtained from the "variation ratio", one learning value is obtained when the injection quantity is small. The other learning value is obtained when the injection quantity is large.

Figure 6:
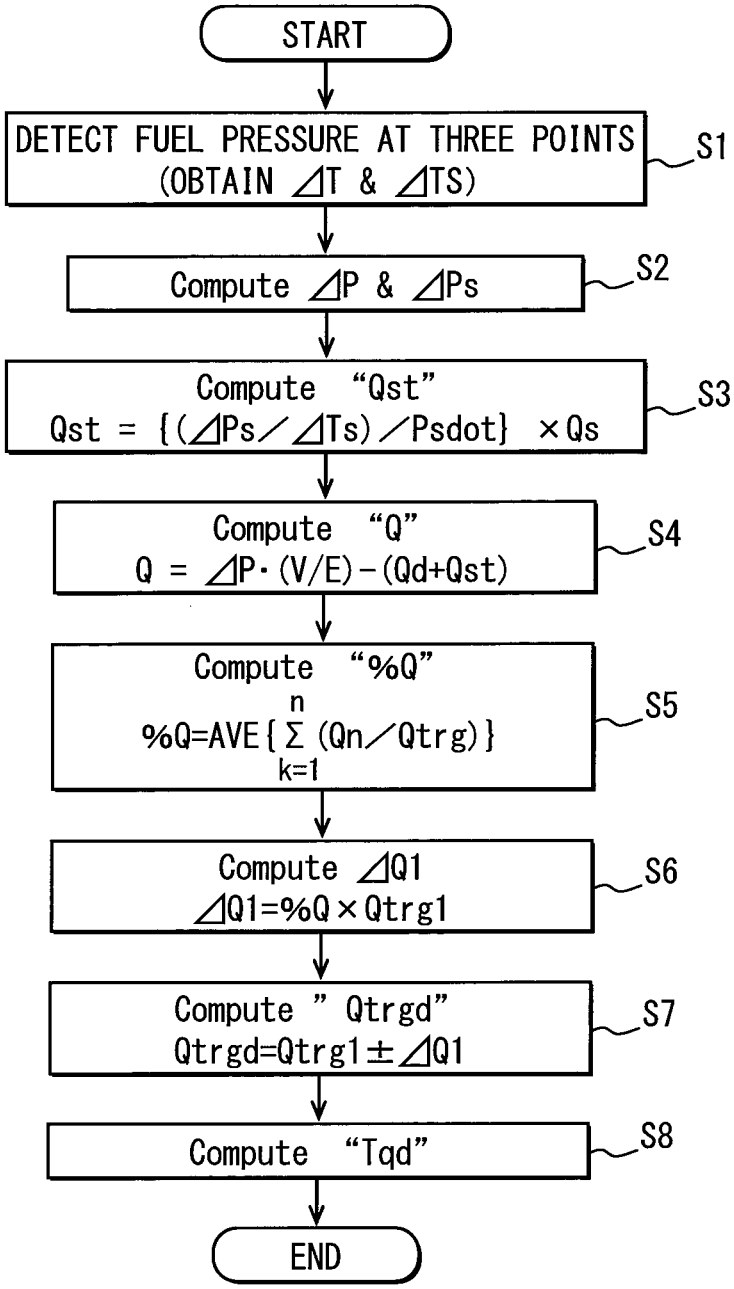
FIG. 6 is a flowchart showing an injector control.

Referring to a flowchart shown in FIG. 6, a processing of the individual difference correcting portion (control program) will be described. In S1 to S5, the learning value (individual difference index % Q) is computed. In S6 to S8, the correction is conducted based on the learning value (individual difference index % Q).

In S1, a pressure P1 before the injection, a pressure P2 immediately after the fuel injection and a pressure P3 after the fuel injection is terminated (refer to FIG. 3) are detected by the fuel pressure sensor 8. Then, a time difference ΔT between a time when the pressure P1 is detected and a time when the pressure P3 is detected is obtained. Further, a time difference ΔTs between a time when the pressure P2 is detected and a time when the pressure P3 is detected is obtained.

In S2, the fuel pressure drop ΔP is obtained based on a pressure variation (P1–P2), and a fuel pressure drop ΔPs due to the static leak is obtained based on a pressure variation (P2–P3) after the fuel injection.

In S3, the static leak amount "Qst" is obtained based on the time difference ΔTs, the fuel pressure drop ΔPs and a reference pressure variation "Psdot".

In S4, the actual injection quantity "Q" is computed based on the fuel pressure drop ΔP as follows:

$$Q=(V/E)\times\Delta P-(Qd+Qst).$$

In S5, the individual difference index % Q is obtained based on the slope of "variation ratio" and the individual difference index % Q is stored as a learning value.

In S6, by means of the individual difference index % Q stored as the learning value, a correction injection quantity ΔQ1 is obtained.

Then, in S7, the correction injection quantity ΔQ1 is added to the target injection quantity Qtrg to obtain a corrected target injection quantity "Qtrgd".

In S8, a corrected target-energization period "Tqd" is obtained based on the corrected target injection quantity "Qtrgd".

(First Advantage of Embodiment)

As described above, in the fuel injection apparatus of the present disclosure, the control unit 4 computes actual injection quantity "Q" based on a fuel pressure drop AP detected by the pressure sensor 8 when the fuel is injected. The individual difference index % Q is obtained based on the slope of "variation ratio Q/Qtrg" and the individual difference index % Q is stored as a learning value. The individual-difference correction of the fuel injector 3 is conducted based on the individual difference index % Q.

Thus, by using the individual difference index % Q as an index of the individual difference, a shot-dispersion is removed and individual-difference correction of the fuel injector 3 can be performed.

That is, the individual-difference correction of the fuel injector 3 can be practically conducted by means of the pressure sensor 8 provided to the commonrail 1. Furthermore, even if the individual difference of the fuel injector 3 is varied due to an abrasion wear or clogging, the individual difference of the fuel injector 3 can be corrected.

Specifically, the individual-difference correction of each fuel injector 3 is conducted and each fuel injector 3 can precisely inject the fuel of the target injection quantity "Qtrg". Thus, a difference between the injection quantity "Q" and the target injection quantity "Qtrg" can be smaller, so that a torque variation is restricted, the fuel consumption is improved, and the engine noise can be restricted.

(Second Advantage of Embodiment)

Since the fuel injection apparatus calculates the actual injection quantity in view of the leak amount (dynamic leak amount "Qd" and static leak amount "Qst"), an accuracy of the individual difference index % Q (learning value) can be enhanced. As the result, an accuracy of the individual-difference correction of the fuel injector 3 can be improved.

(Third Advantage of Embodiment)

As mentioned above, the individual difference index % Q obtained under a certain pressure conditions can be generally used as the constant value, even if the target pressure of the common-rail 1 is varied or the target injection quantity Qtrg is varied.

That is, when the individual difference index % Q is obtained by at least one learning, the individual difference correction of the fuel injector 3 can be conducted in whole drive range.

For this reason, even if the individual-difference correction of the fuel injector 3 can not be conducted by using of QR code (trademark), the individual difference correction of the fuel injector 3 can be conducted in whole drive range.

(Fourth Advantage of Embodiment)

Even after the vehicle with the injector is shipped, by conducting the individual difference correction periodically, various leanings can be conducted, so that the accuracy of the individual difference correction can be enhanced in a wide driving range.

Specifically, the various learning values obtained in a wide driving range are mapped. Based on the learning values on the map, the individual difference correction is conducted. The injection accuracy of the fuel injector 3 can be kept high for a long period.

(First Modification of Embodiment)

In order to estimate the volume modulus E of a fuel with high accuracy, measured values of fuel temperature can be transmitted to the control unit 4.

(Second Modification of Embodiment)

In order to estimate the volume modulus E of a fuel with high accuracy, an actual property of the pressure sensor 8 can be transmitted to the control unit 4.

(Third Modification of Embodiment)

In order to improve a detection accuracy of the pressure sensor 8, the influence of the fuel pressure pulsation can be deleted by an analog circuit or digital processing.

(Fourth Modification of Embodiment)

In order to improve the detection accuracy of fuel pressure drop ΔP, the volume of the common-rail 1 may be reduced.

The fuel injector 3 may be a three-way injector, a direct-type fuel injector, a piezo actuator, etc.

What is claimed is:

1. A fuel injection apparatus comprising:

a common rail accumulating a fuel;

a fuel injector injecting the fuel in the common-rail;

a pressure sensor detecting a fuel pressure accumulated in the common-rail; and a control unit performing an injection control of the fuel injector based on a driving condition which includes the fuel pressure detected by the pressure sensor, wherein the control unit computes actual injection quantity based on a fuel pressure drop detected by the pressure sensor when the fuel is injected, the control unit computes an individual difference index based on a slope of variation ratios between a plurality of actual injection quantity and a target injection quantity, and the control unit performs an individual-difference correction of the fuel injector based on the individual difference index as a learning value.

2. A fuel injection apparatus according to claim 1, wherein the individual difference index is expressed by the slope of the variation ratios in a relation between the target injection quantity and an individual difference, and the control unit computes a correction injection quantity based on the individual difference index and the target injection quantity.

3. A fuel injection apparatus according to claim 2, wherein:

the control unit computes an energization period of the fuel injector based on a corrected target injection quantity which is corrected based on the correction injection quantity.

4. A fuel injection apparatus according to claim 1, wherein:

the control unit computes the actual injection quantity in view of a fuel leak from the fuel injector to a fuel tank.

5. A fuel injection apparatus according to claim 1, wherein:

the control unit employs the individual difference index as a constant value with respect to any target injection quantity.

6. A fuel injection apparatus according to claim 1, wherein:

the control unit employs the individual difference index as a constant value with respect to any target pressure of the common-rail.

* * * * *